US005941476A

United States Patent [19]

Copass

[11] Patent Number: 5,941,476

[45] Date of Patent: Aug. 24, 1999

[54] PORTABLE ENCLOSURE FOR STORAGE AND DISPENSING OF MULTIPLE PAPER ROLLS

[76] Inventor: Nicholas S. Copass, 90 Mira Mesa, Rancho Santa Margarita, Calif. 92688

[21] Appl. No.: 09/188,955

[22] Filed: Nov. 10, 1998

[51] Int. Cl.[6] ..... B65D 85/672

[52] U.S. Cl. ..... 242/588.6; 242/596.8; 206/391; 206/397

[58] Field of Search ..... 242/588.6, 594, 242/596, 596.7, 596.8; 206/391, 395, 397

[56] References Cited

U.S. PATENT DOCUMENTS

| | | | |
|---|---|---|---|
| 374,357 | 12/1887 | Geiger et al. . | |
| 376,641 | 1/1888 | Dille et al. . | |
| 376,642 | 1/1888 | Dille et al. . | |
| 548,987 | 10/1895 | Heyman | 242/594 |
| 848,100 | 3/1907 | Greenawalt . | |
| 941,282 | 11/1909 | Smitson et al. . | |
| 1,059,160 | 4/1913 | Hornbostel . | |
| 1,231,475 | 6/1917 | Bergman . | |
| 1,462,333 | 7/1923 | Girard . | |
| 1,501,619 | 7/1924 | Pickell . | |
| 1,902,826 | 3/1933 | Bobo . | |
| 1,931,276 | 10/1933 | Warner | 242/598.5 |
| 2,110,771 | 3/1938 | McCauley . | |
| 2,416,509 | 2/1947 | Beaulieu . | |
| 2,550,209 | 4/1951 | Tuttle | 242/596.8 |
| 2,590,384 | 3/1952 | Dent et al. . | |
| 2,954,823 | 10/1960 | Davis . | |
| 3,204,887 | 9/1965 | Hansen et al. . | |
| 3,314,531 | 4/1967 | Cheris et al. | 206/391 |
| 3,486,708 | 12/1969 | Lamon . | |
| 3,743,206 | 7/1973 | Reigger . | |
| 4,033,455 | 7/1977 | Robison | 206/391 |
| 4,523,725 | 6/1985 | Futagawa . | |
| 4,614,075 | 9/1986 | Focke et al. . | |
| 4,903,909 | 2/1990 | Suzuki . | |
| 5,036,359 | 7/1991 | Duijve et al. . | |
| 5,205,508 | 4/1993 | Masera et al. . | |
| 5,305,937 | 4/1994 | Barnett | 242/598.6 |
| 5,593,035 | 1/1997 | Taylor et al. | 206/397 |
| 5,657,944 | 8/1997 | Kewin . | |

FOREIGN PATENT DOCUMENTS

| | | | |
|---|---|---|---|
| 59-186853 | 10/1984 | Japan | 242/596 |
| 59-186859 | 10/1984 | Japan | 242/596 |

*Primary Examiner*—John P. Darling
*Attorney, Agent, or Firm*—Stetina Brunda Garred & Brucker

[57] ABSTRACT

A portable paper roll enclosure and more particularly to an enclosure and reel assembly for storing a plurality of paper rolls. A first embodiment comprises a hexagonal elongate housing with a reel assembly supported therein and rotatable about an axis. Two disks are placed on a center rod member and include a plurality of protuberances wherein opposing sets of protuberances support rolls of wrapping paper. The housing can be opened and closed for access to the reel assembly. A second embodiment includes a modified reel assembly by including a divider member between the end of the hexagonal housing and the disk member to create a compartment for storage.

18 Claims, 2 Drawing Sheets

PORTABLE ENCLOSURE FOR STORAGE AND DISPENSING OF MULTIPLE PAPER ROLLS

FIELD OF THE INVENTION

The present invention relates generally to a portable paper roll enclosure, and more particularly to an enclosure and reel assembly for storing a plurality of paper rolls and for dispensing of wrapping paper from the rolls.

BACKGROUND OF THE INVENTION

Conventional gifting etiquette attendant to holidays, birthdays and other occasions provides that a gift be wrapped or boxed to conceal its contents. Although placing a gift in a box has been traditional throughout history and decorative bags have gained popularity in recent years, the most popular form of gift concealment in modern times is decorative wrapping paper.

Decorative wrapping paper is typically sold at retail in folded sheet form or standard paper roll form. The majority of wrapping paper is sold at retail in the paper roll format. A standard wrapping paper roll is typically 30⅛ inches in length, with varying diameters of the cardboard center.

Typically, consumers purchasing one or more rolls of wrapping paper have remaining paper left on the roll after use. Accordingly, storage of the remaining paper is required. Also, the consumer may wish to purchase rolls in advance of a holiday or other gift-giving event and it is necessary to store these wrapping paper rolls at home or other location. Storage of such rolls for the consumer is problematic as the length of the rolls make it difficult for the consumer to store the product easily within a standard piece of in-home furniture. Further, it is desirable to keep the wrapping paper in the best condition possible for its use, and exposure to the elements or dust, such as may be encountered in a garage, attic, or basement, may leave the wrapping paper in an undesirable condition. Also, the wrapping paper rolls are subject to creasing or crushing due to mishandling if the rolls are stored improperly.

Wrapping paper rolls may be potentially stored in cardboard boxes or other similar containers, however, such storage boxes or containers do not provide an easy mechanism for accessing the paper rolls. Furthermore, typical containers in which a consumer may store wrapping paper rolls do not provide simplistic means for dispensing the paper from the rolls to properly size the paper to be placed on a gift box.

Accordingly, there is a great need for a device that will allow cosumers to store wrapping paper rolls to prevent damage or crushing of the rolls as well as minimal degradation to the decorative wrapping paper. Additionally, there is a long-felt need for a device to allow consumers to easily dispense the paper from the roll while additionally effectively storing multiple rolls.

SUMMARY OF THE INVENTION

In accordance with the preferred embodiment of the present invention, a paper roll storage and dispensing device is disclosed. The paper roll storage and dispensing device of the present invention comprises of an elongate housing having a hexagonal outer shape with vertical end walls on either side. The housing includes a lid member and base member which are interconnected via a hinge crease. The elongate housing may be opened and closed by lifting the lid member away from the base member.

Supported within the housing, and rotatable about an axis in general parallel relation to the length of the elongate housing, is a reel assembly. The reel assembly includes a center rod rotatably engaged to the housing by end caps secured to the housing end walls. The center rod member supports first and second disk members which are disposed on, and extend radially outward from said rod member. The first and second disk members include a plurality of protuberances formed on the inner surface of the disk members. The disks are fictionally secured to the center rod member with rubber grommets, and upon rotation on the center rod member, the disks also rotate. The disks are frictionally secured to the center rod member so that a disk does not move independent of the opposing disk.

The plurality of protuberances are formed circumferentially on the inner surfaces of said first and second disk members. Paper rolls engage opposing pairs of protuberances on either side. Preferably, each disk includes eight protuberances totalling eight opposing pairs. Each opposing pairs of protuberances operates to engage the paper roll and allow rotation of the paper roll much like a paper towel holder.

In accordance with the preferred embodiment of the present invention, a consumer can store multiple rolls of wrapping paper on eight opposed pairs of protuberances, and the reel assembly can be rotated in either direction within the housing to allow the user access to the plurality of paper rolls. A serrated edge may be formed on to the base panel portion of the elongate housing to aid in the dispensing in cutting of paper from the rolls. Additional space within the housing may be used for storage of other items such as ribbon, tape, scissors and the like. The housing can then be closed and secured shut for storage and transportation of the paper rolls. A handle may be attached to the outer surface of the housing to allow easy transportation of the device.

In a second embodiment of the present invention, there is shown a modified reel assembly which is supported within the aforementioned housing. The modified reel assembly include elongate rod member which is supported by the end walls via the end caps and is rotatable therebetween. First and second disk members are placed upon the rod member through apertures formed in the disk members. About the apertures a collar member is formed onto the disk to provide stability to the disk upon the rod member to prevent unwanted movement of the disk members. A divider member is also placed on the rod member between the second disk member and an end wall. The divider member provide a compartment which allows storage of additional gift wrapping implement and prevents those materials and implements from interfering with the rotation of the disk member.

It should be noted and understood that with respect to the embodiments of the present invention, the materials suggested may be modified or substituted to achieve the general overall resultant high efficiency. The substitution of materials or dimensions remain within the spirit and scope of the present invention.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENTS

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Figure 1:
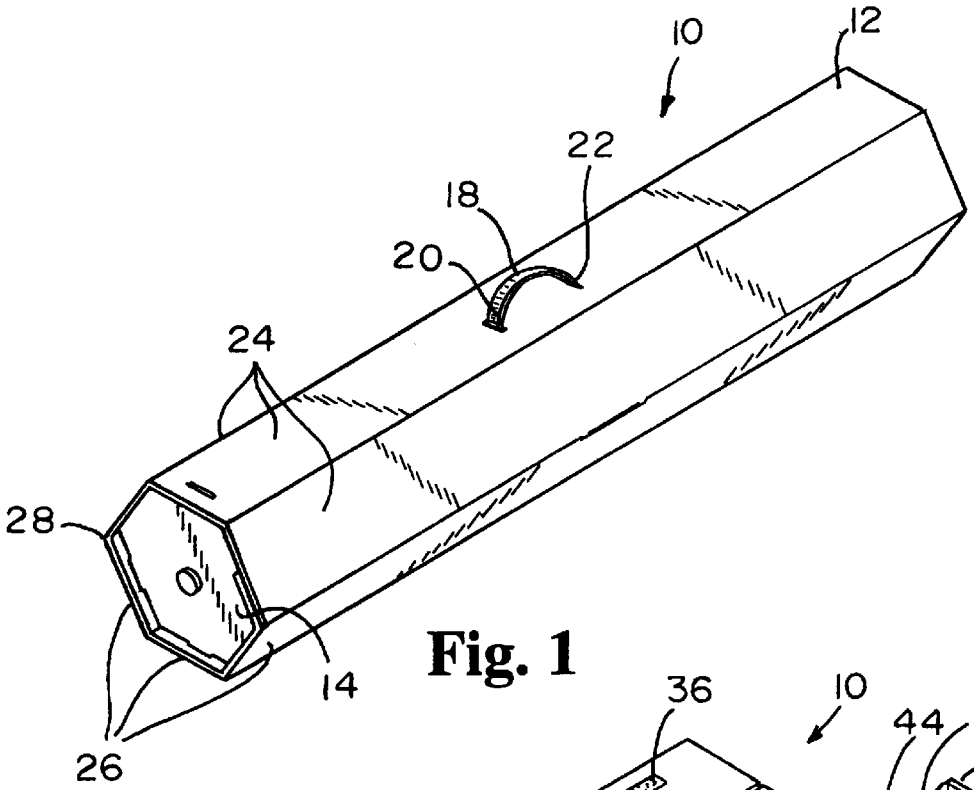
FIG. 1 is a perspective view illustrating the paper roll enclosure of the present invention showing the enclosure in a closed transportable position.

Referring now to the drawings wherein the showings are for purposes of illustrating preferred embodiments of the present invention only, and not for purposes of limiting the same, FIG. 1 shows the paper roll enclosure 10 of the present invention in a closed transportable position. The enclosure sidewall 12 is preferably formed of corrugated cardboard. The paper roll enclosure 10 is constructed from the cardboard side wall 12 and end walls 14 and 16 (shown in FIG. 2). The end walls 14 and 16 are also preferably formed of corrugated cardboard. Preferably the paper roll enclosure is 40 inches long and 10 inches in height. The end walls 14 and 16 are preferably inset approximately ¾ inches from the ends of the side wall 12. It is understood and contemplated by the invention that while the preferred embodiment paper roll enclosure 10 is formed from corrugated cardboard, it may equally be comprised of any rigid or semi-rigid material such as metal, plastic or composite materials.

The paper roll enclosure 10 includes a plastic handle 18 which allows a user to grasp the paper roll enclosure 10 by the handle 18 and manually transport the same. The handle 18 engages side wall 12 through slots 20 and 22. The handle 18 may be formed of other suitable material such as strong fabric material, straps or rubber.

Figure 2:
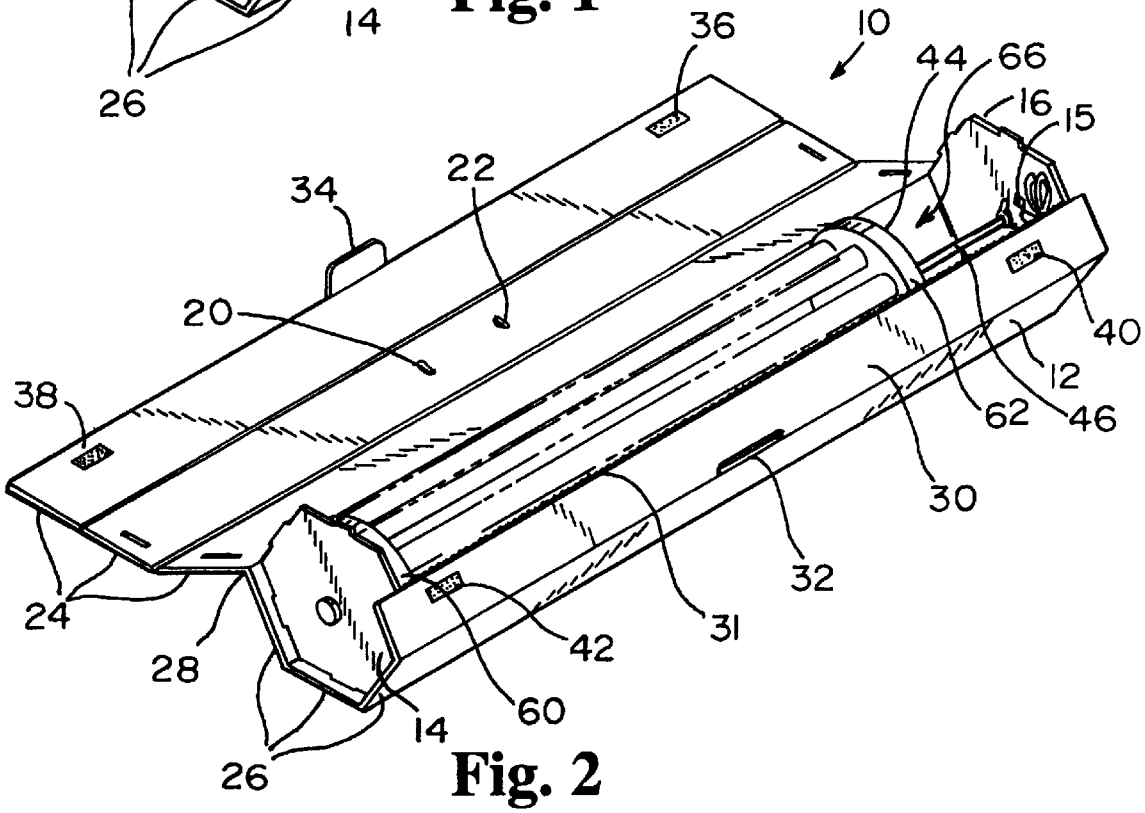
FIG. 2 is a perspective view of the enclosure in an open position to allow access to stored paper rolls constructed in accordance with the present invention.
Figure 3:
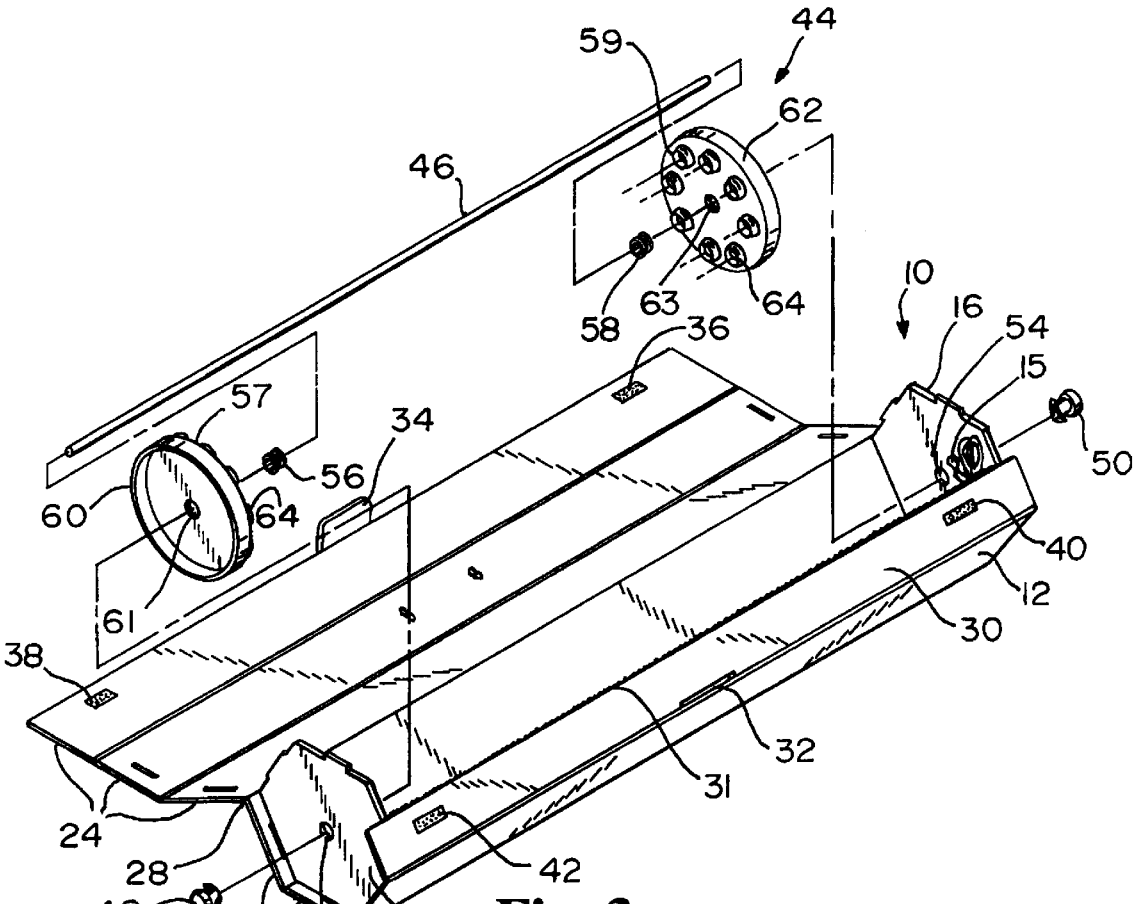
FIG. 3 is a perspective view of the enclosure in an open position with an exploded view of the reel assembly portion of the device.

Referring to FIGS. 1, 2 and 3, collectively, the cardboard side wall 12 is preferably formed from a unitary piece of cardboard having a plurality of creases to form the hexagonal structure. The hexagonal structure is formed into six equal panels along the creases with three panels forming the lid panels 24 and three panels forming the base panels 26. The top panels 24 articulate along a hinge crease 28. In this regard, the paper roll enclosure 10 is shown in a closed position in FIG. 1 and in open position in FIGS. 2 and 3. Although the preferred embodiment contemplates a hexagonal structure, the enclosure 10 may be formed as any suitable elongate structure such as a cylinder or box-like structure with rectangular side walls.

An additional half panel 30 is formed on the base panels 26 and additionally includes an insert slot 32 to receive insert tab 34 when the paper roll enclosure 10 is in a closed position. The insert tab 34 is formed on the lid panels 24. As an additional means for securing the lid panels 24 to the base panels 26, when the paper roll enclosure 10 is in a closed position, the lid panels 24 include velcro strips 36 and 38 which mate with corresponding velcro strips 40 and 42 formed on the half panel 30. It is additionally contemplated by the present invention that other securing means may be utilized to secure the paper roll enclosure such as a hook latch, adhesive strips, buckles, straps or any other light weight means of securing the lid to panels 24 to the base panel 26. Further, it is contemplated by the present invention that the hinge crease 28 may be replaced by a hinge mechanism where the lid panels 24 and base panels 26 are separated.

Additionally, along the leading edge of the half panel 30, a serrated edge 31 is formed thereon. The serrated edge aids a user in cutting wrapping paper which is removed from the paper roll enclosure 12. Additionally, end wall 16 includes a strap 15 fixed to the inner surface of end wall 16 to allow the insertion of scissors or other useful wrapping paper implement. On the inner side of the lid panels 24 are two additional straps (not shown) each for holding folded wrapping paper. Further elastic straps (not shown) are placed on the inside surface of the base panels 26 to hold a gift card and tag cards.

The end walls 14 and 16 are fixed to the sidewall 12 by standard insert slot and insert tab arrangement along each panel. The hexagonal end walls 14 and 16 have insert slots (not shown) centered along each side to correspond with a insert slot formed on side wall 12. Although not shown, each of the lid bottom panels 24 have duel slots adapted to receive an insert slot formed on the end wall 14 and 16. Elongate insert tabs of the end walls 14 and 16 mate with insert slots formed on the base panels 26 along the outer surface of the paper roll enclosure 10 and into second parallel insert slots to secure the end walls 14 and 16 to the side walls 12. Other means of securing the end walls to the side walls 12 are contemplated such as glue or other bonding.

Referring collectively to FIGS. 2 and 3, the paper roll enclosure 10 is shown in an open position with the lid panels 24 opened away from the base panels 26 to expose the reel assembly 44. The reel assembly 44 comprises a center rod member 46 which is rotatably engaged to the enclosure 10 housing by end caps 48 and 50 which extend through apertures 52 and 54 of end walls 14 and 16. The ends of the rod member 46 mate with the end caps 48 and 50 and the rod member 46 rotates freely within the end caps 48 and 50. The rod member 46 is preferably a wood dowel and may also be formed of plastic or other rigid material. In the preferred embodiment, the rod member 46 is a cylindrical rod, but may additionally have other shaped cross-sections such as a square, hexagonal or other operable cross-section. Also, in the preferred embodiment, the end caps 48 and 50 may be any suitable engagement member which will allow the rod member to rotate freely.

Figure 4:
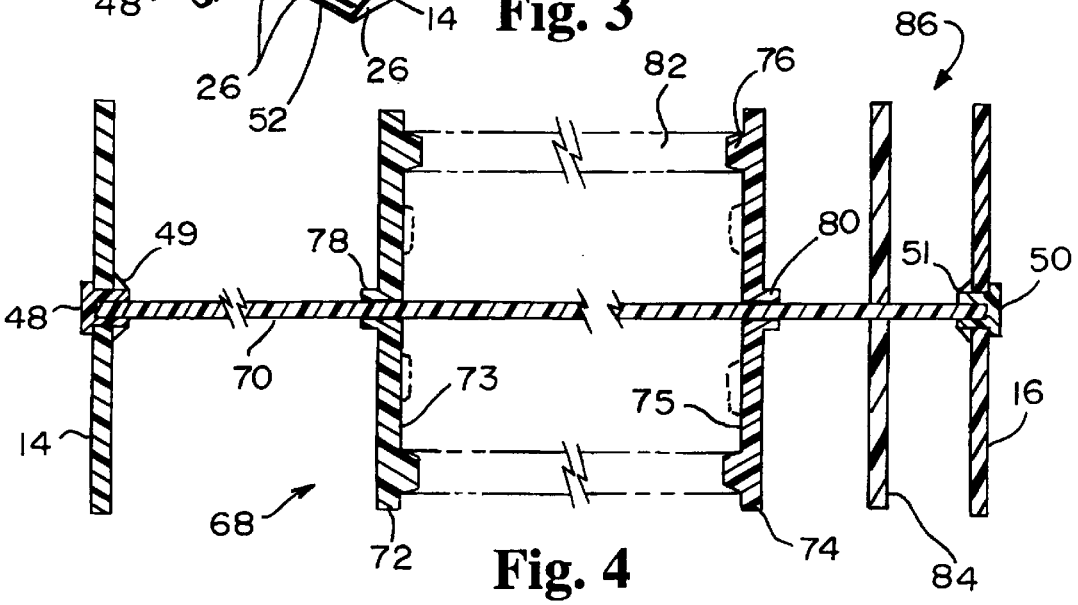
FIG. 4 is a cross-sectional view of one of the components of the reel assembly of a second embodiment of the present invention.

The rod member 46 extends through grommets 56 and 58 which allow a frictional fit with disk members 60 and 62. The disk members 60 and 62 are preferably 8 inches in diameter. Although in the preferred embodiment the disk members 60 and 62 are 8 inches in diameter, the size may vary depending on the number of rolls to be secured in the device or the size of the enclosure 10. Also, such members may be formed in shapes other than disks. Preferably, the disks 60 and 62 are formed of cardboard but may be formed of any suitable rigid material such as plastic (as shown in FIG. 4), metal or composite material. The grommets 56 and 58 are preferably formed of rubber but may additionally be comprised of other suitable material. The disks 60 and 62 include apertures 61 and 63 respectively to allow passage of the rod member 46 therethrough. The grommets 56 and 58 are preferable placed 30 and 3/16 inches apart for standard sized paper rolls, but may be adjusted as needed.

In the preferred embodiment, each of the disk members 60 and 62 have eight protuberances 64 formed circumferentially about the inner surfaces 57 and 59 the disk members. Preferably, the disk members 60 and 62 include 8 protuberances 64, each protuberance 64 is preferably rounded or domed shaped extending approximately ½ inch from the inner surfaces 57 and 59 of the disk members 60 and 62. Each protuberance 64 is placed circumferentially within ¼ inch of the outer diameter of the disk members 60 and 62. Each protuberance 64 is 1⅛ inch in diameter. The number of protuberances may vary depending on the number of rolls to be secured or the size of the disk members.

In operation, as best shown in FIG. 2, wrapping paper rolls engage corresponding protuberances 64 on disk members 60 and 62 and the paper roll frictionally fits between disk member 60 and 62. The corresponding proprotuberances 64 can engage eight rolls of paper (shown in Phantom). Additional rolls of paper can be placed within the outer circumference of the protuberances 64 and are held in place by the secured rolls. Accordingly, the present invention can effectively store approximately 12 rolls of paper of relative equal length.

With the reel assembly 44 suspended within the paper roll enclosure 10, about the rod member 46, the reel member 44 rotates about an axis generally parallel to the length of the paper roll enclosure 10. The reel assembly 44 can be rotated within the paper roll enclosure 10 in either direction to allow the user access to the wrapping paper of choice. Each roll of wrapping paper can then be spun about a corresponding protrusions 64 on the disk members 60 and 62 much like a paper towel dispenser. The paper can then be cut directly from the paper roll with scissors or other cutting device, or the user may utilize the serrated edge 31 to affect a cutting of the wrapping paper. Additionally, the paper rolls may be easily removed from the reel assembly or replaced with a new roll.

As shown best in FIG. 2, the paper roll enclosure 10 includes an extra storage area 66 to allow a user to store ribbon, tape or other gift wrapping material. Disk member 60 is preferably placed approximately ¾ of an inch away from the end wall 14 while opposing disk member 62 is placed approximately 7 inches away from end wall 16. Disk members 60 and 62 are adjustable laterally along the rod member 46 and a storage area may be formed on either side or the reel assembly. Additionally, the reel assembly 44 may be centered within the paper roll enclosure 10 to form two smaller storage areas (not shown) on either side of the reel assembly.

Referring particularly to FIG. 4, there is shown a second embodiment of the present invention which comprises a modified reel assembly 68. The reel assembly 68 is suspended within the paper roll enclosure 10 as shown in FIGS. 1, 2 and 3 by end caps 48 and 50 engaged to end walls 14 and 16.

Rod member 70 is rotatably engaged with the paper roll enclosure 10 via the end caps 48 and 50. The second embodiment of the present invention includes modified disk members 72 and 74. The disk members 72 and 74 additionally include a plurality of protuberances 76 formed circumferentially upon one surface of the disks 72 and 74. Preferably the disks 72 and 74 have eight protuberances 76 formed on the inner surfaces 73 and 75. The protuberance 76 are shown in cross section as well as in phantom.

The disk members 72 and 74 are preferably formed of molded or vacuum formed plastic or other rigid material which additionally include collars 78 and 80 to stabilize the disk 72 and 74 and prevent unwanted movement of the disks 72 and 74. The snug frictional fit of the disk member 72 and 74 upon the rod member 70 allow both disks 72 and 74 to spin together and not independent of each other to allow a proper alignment of protuberance 76 to maintain a paper roll 82 (shown in phantom) secured within the reel assembly 68. The disk member 72 and 74 are adjustable laterally on the rod member 70. An additional divider member 84 may be fit about the rod member 70 through an aperture. The divider member 84 creates a separate storage compartment 86 to allow storage of material such as tape, ribbons or other wrapping material or implements. The divider 84 keeps the material or implements from interfering with the rotation of the disk member 74.

Additional modifications and improvements of the present invention may also be apparent to those skilled in the art. Thus, the particular combination of the parts described and illustrated herein is intended to represent only one embodiment of the present invention, and is not intended to serve as limitations of alternative devices within the spirit and scope of the invention.

What is claimed is:

1. A paper roll storage and dispensing device comprising:

(a) an elongate housing;

(b) a reel assembly supported within said housing and rotatable about an axis in general parallel relation to the length of said elongate housing, said reel assembly comprising:

a center rod member rotatably engaged to the housing;

a first generally planar panel member disposed on and extending radially from said center rod member;

a second generally planar panel member disposed on and extending radially from said center rod member; and a plurality of protuberances formed on each of the panel members to engage at least one paper roll extending between the panel members.

2. The paper roll storage and dispensing device of claim 1 wherein said center rod member has a generally cylindrical configuration.

3. The paper roll storage and dispensing device of claim 1 wherein said center rod member is a wood dowel.

4. The paper roll storage and dispensing device of claim 1 wherein said center rod member is a plastic dowel.

5. The paper roll storage and dispensing device of claim 1 wherein said center rod member has a generally circular cross-section.

6. The paper roll storage and dispensing device of claim 1 wherein said first and second panel members have a generally circular configuration.

7. The paper roll storage and dispensing device of claim 6 wherein said first and second circular panel members have inner and outer surfaces and wherein said protuberances are formed on each inner surface of said panel members.

8. The paper roll storage and dispensing device of claim 7 wherein said plurality of protuberances are disposed circumferentially on said inner surfaces of said first and second panel members.

9. The paper roll storage and dispensing device of claim 1 wherein said elongate housing is formed from corrugated cardboard.

10. The paper roll storage and dispensing device of claim 1 wherein said elongate housing includes a base member and a lid member.

11. The paper roll storage and dispensing device of claim 10 wherein said base member is interconnected to said lid member along a hinge crease.

12. The paper roll storage and dispensing device of claim 11 wherein said base member includes a serrated strip formed along the length of the base member.

13. The paper roll storage and dispensing device of claim 12 wherein said serrated strip is formed of metal.

14. The paper roll storage and dispensing device of claim 13 wherein said serrated strip is formed of plastic.

15. The paper roll storage and dispensing device of claim 1 wherein said first and second planar panel members are formed of plastic.

16. The paper roll storage and dispensing device of claim 1 wherein said elongate housing has a first and second vertical end walls wherein said reel assembly is supported therebetween.

17. The paper roll storage and dispensing device of claim 16 wherein said reel assembly further comprises a divider member disposed on and extending radially from said center rod member wherein said divider member is placed on the center rod member between said first panel member and said first end wall.

18. The paper roll storage and dispensing device of claim 16 wherein said reel assembly further comprises a divider member disposed on and extending radially from said center rod member wherein said divider member is placed on the center rod member between said second panel member and said second end wall.

* * * * *